US009284770B2

(12) United States Patent
Sprague

(10) Patent No.: US 9,284,770 B2
(45) Date of Patent: Mar. 15, 2016

(54) ADJUSTABLE SCREEN TENSIONING SYSTEM

(71) Applicant: Gary Sprague, Los Angeles, CA (US)

(72) Inventor: Gary Sprague, Los Angeles, CA (US)

(73) Assignee: C.R. LAURENCE CO., INC., Los Angeles, CA (US)

( * ) Notice: Subject to any disclaimer, the term of this patent is extended or adjusted under 35 U.S.C. 154(b) by 64 days.

(21) Appl. No.: 14/219,746

(22) Filed: Mar. 19, 2014

(65) Prior Publication Data

US 2015/0267459 A1 Sep. 24, 2015

(51) Int. Cl.

| | |
|---|---|
| ***E06B 3/30*** | (2006.01) |
| ***E06B 9/24*** | (2006.01) |
| ***E06B 9/52*** | (2006.01) |

(52) U.S. Cl.

CPC . *E06B 3/308* (2013.01); *E06B 9/24* (2013.01); *E06B 9/52* (2013.01); *E06B 9/522* (2013.01); *E06B 2009/524* (2013.01); *E06B 2009/527* (2013.01)

(58) Field of Classification Search

CPC ..... E06B 9/522; E06B 9/52; E06B 9/527
USPC ..... 160/382, 383, 387, 395, 399, 378, 371
See application file for complete search history.

(56) References Cited

U.S. PATENT DOCUMENTS

| | | | | |
|---|---|---|---|---|
| 2,335,361 | A | 11/1943 | Schiller | |
| 2,627,311 | A * | 2/1953 | Kaufmann | 160/395 |
| 2,709,489 | A * | 5/1955 | Keebler | 160/381 |
| 3,220,469 | A * | 11/1965 | Oehmig | 160/380 |
| 3,341,013 | A * | 9/1967 | Moulton | 209/403 |
| 3,421,276 | A * | 1/1969 | La Barge | 52/287.1 |
| 3,541,957 | A * | 11/1970 | Bubley | 101/127.1 |
| 3,805,873 | A * | 4/1974 | Bloomfield | 160/392 |
| 4,153,981 | A * | 5/1979 | Stuppy | 24/456 |
| 4,232,310 | A * | 11/1980 | Wilson | 340/550 |
| 4,409,749 | A * | 10/1983 | Hamu | 38/102.3 |
| 4,788,806 | A * | 12/1988 | Sease | 52/222 |
| 4,838,332 | A * | 6/1989 | Mlenek | 160/90 |
| 4,879,777 | A * | 11/1989 | Goodwin | 5/689 |
| 4,899,797 | A * | 2/1990 | Green | 160/395 |
| 4,937,961 | A * | 7/1990 | Gandy et al. | 40/603 |
| 4,955,928 | A * | 9/1990 | Tanner | 40/603 |

(Continued)

FOREIGN PATENT DOCUMENTS

AU 2008202835 6/2008

*Primary Examiner* — Katherine Mitchell
*Assistant Examiner* — Johnnie A Shablack
(74) *Attorney, Agent, or Firm* — Cislo & Thomas, LLP

(57) ABSTRACT

An adjustable screen re don system is presented. The present invention screen retention system comprises a mesh Of perforate screen retained within a frame composed of frame members have channel cross sections. The screen is formed with a rolled or U-shaped edge hem. The edge hem having a free edge that folds inwardly over the inner face of the screen and is parallel to, and spaced above, the inner face of the screen. The framing members are channel section extrusions which contain features for retaining, tensioning and locking the screen. The adjustable screen retention system herein presented improves upon the prior art by providing a more secure attachment of the screen within the channel of the frame members thereby providing increased resistance to screen impact loading. The new system also provides for a broader range of screen of tensioning adjustment than has heretofore been available and further electrically isolates the screen from the walls of the channel.

14 Claims, 3 Drawing Sheets

(56) References Cited

U.S. PATENT DOCUMENTS

| | | | | | |
|---|---|---|---|---|---|
| 5,209,029 | A * | 5/1993 | Foerst | 52/63 |
| 5,245,774 | A * | 9/1993 | Huber | 40/603 |
| 5,259,323 | A * | 11/1993 | Koch et al. | 105/20 |
| 5,398,388 | A * | 3/1995 | Coleman | 24/593.11 |
| 5,467,546 | A * | 11/1995 | Kovalak, Jr. | 40/603 |
| 5,502,906 | A * | 4/1996 | Yamawaki | 38/102 |
| 5,572,821 | A * | 11/1996 | Coleman | 40/603 |
| 5,647,155 | A * | 7/1997 | Hillstrom | 40/603 |
| 5,702,147 | A * | 12/1997 | Essig | 296/106 |
| 6,088,942 | A * | 7/2000 | Brooks et al. | 40/603 |
| 6,125,910 | A * | 10/2000 | Pepperell et al. | 160/371 |
| 6,412,538 | B1 * | 7/2002 | Welfonder | 160/271 |
| 6,637,080 | B2 * | 10/2003 | Verret | 24/462 |
| 6,802,357 | B2 | 10/2004 | Taylor et al. | |
| 6,892,787 | B1 | 5/2005 | Stretch | |
| 7,165,296 | B2 * | 1/2007 | Coleman | 24/462 |
| 7,537,043 | B2 | 5/2009 | Veivers et al. | |
| 7,934,350 | B2 | 5/2011 | Koutsoukos | |
| 8,016,013 | B2 * | 9/2011 | Horvath | 160/23.1 |
| 8,191,606 | B2 | 6/2012 | Edlin | |
| 8,297,197 | B2 * | 10/2012 | Tabellini et al. | 105/20 |
| 8,347,939 | B2 * | 1/2013 | Brabeck et al. | 160/380 |
| 8,985,183 | B2 * | 3/2015 | Terry | 160/378 |
| 2009/0159222 | A1 | 6/2009 | Moriya et al. | |
| 2010/0147471 | A1 * | 6/2010 | Bull | 160/381 |
| 2012/0073771 | A1 | 3/2012 | Dickison et al. | |
| 2014/0130993 | A1 * | 5/2014 | Zwar | 160/371 |

* cited by examiner

ADJUSTABLE SCREEN TENSIONING SYSTEM

BACKGROUND OF THE INVENTION

1. Field of the Invention

The present invention relates to screens for windows, doors and the like, and in particular, to a screen retention assembly for securing a screen to a frame or surround. The invention presented is primarily intended for security screens that deter human intruders and provide impact protection from flying debris. However, the system may also be used for security screens that prevent the intrusion of insects and small animals into a building.

2. Background of the Invention

Doors or windows incorporating a semi-transparent screen or mesh provide the advantages of visibility, ventilation, and also the ability to prevent the passage of insects or small animals through the aperture covered by the screen. Screens are typically made from a flexible wire mesh although other flexible or semi-rigid perforate sheet materials may be used.

Common prior art screen systems attach the mesh directly to the perimeter of the window or door opening with simple fasteners such as screws, rivets or glue. While such systems are functional, they lack a means of applying tension to the screen upon installation. A tensioned screen is important because ordinary use of a door or window often causes repeated impact loads to the screen, for example pushing the door open by pushing or kicking the screen. Thus, the semi-rigid material of the screen often appears floppy after a short period of ordinary use.

The strength and appearance of a screen attached using simple fasteners is also overly dependent on the skill of the fabricator. For example, if the screen is cut slightly too small, the screen will be weakened and subject to pulling out of the frame because the fasteners will be too close to the edge of the mesh. If glue is used, it will not sufficiently cover enough surface area of the mesh to create a strong bond. On the other hand, if the screen is cut slightly to large, then the mesh will be unavoidably floppy because the use of simple fasteners provide no means for tensioning the mesh.

To overcome many of the weaknesses of directly fastening a screen to the perimeter of a window or door opening, more modern systems that frame the openings with extruded metal, typically aluminum, channel sections have been developed, wherein the edges of the screen are secured within the channel walls. A wide variety of means for securing screens within the channel walls have been developed. Prior art systems range from simple friction fits between the screens and the channels to complex turnbuckle like fasteners mounted in the channels which grip and tension the screen.

Screen retention systems that feature channel section frames about the perimeter of door or window opening have effectively overcome many of the drawbacks of systems that attached the screen directly to the door or window frame. Aesthetic appearance has been improved due to the lack of visible fasteners. Function has also been improved because some of the prior channel section screen retention systems have some ability to tension the screen.

Prior an channel-based screen retention systems do suffer from certain drawbacks however. In particular, prior art systems typically use flat or screen edges which allow for only a very limited amount of screen tensioning and offer only modest resistance to screen impact loading. When screen tensioning provisions are specifically provided, they nevertheless often have a very limited adjustment range. In addition, many prior art screen retention systems allow the metal of the screen, typically iron or steel, to contact the wall of the, typically aluminum, channel. This contact of dissimilar metals allows for galvanic corrosion at the interface between the screen and the channel. Power coated stainless steel is the preferred material for security screens. Common insect screens are typically made using vinyl coated fiber glass, aluminum mesh, galvanized steel, bronze, stainless steel, or vinyl coated polyester.

What is needed in the art is an improved channel-based screen retention system that provides a more secure attachment of the screen within the channel to provide increased resistance to screen impact loading. Also desirable is a broader range of screen of tensioning adjustment and for a design that electrically isolates the screen from the walls of the channel, when the channel and screen are both made from metallic materials as is commonly the case.

SUMMARY OF THE INVENTION

It is the purpose of the present invention to provide an improved channel-based screen retention system that increases the resistance to screen impact loading; provides for a broad range of screen tensioning adjustability, and that electrically isolates the screen from the walls of the channel to prevent galvanic corrosion, among other features.

The invention comprises a screen retention system comprised of a screen retained within a frame, the frame being composed of frame members having channel cross sections. In the exemplary embodiment, the frame members are extrusions, the outer perimeter of which frame a window, door, or like structure, or are designed to be received within the opening of a door, window, or like structure, where it is desired to close out the opening with a screen. The mesh or perforate screen features an inner face and an outer face. The perimeter of the screen is formed with a rolled or u-shaped edge hem. The edge hem having a flange which folds inwardly over the inner face of the screen and is parallel to, and spaced above, the inner face of the screen.

The inner perimeter of the members which form the frame for the screen include an opening or main channel for receipt of the screen. In cross section, an upper interior wall of the main channel of each frame member has a serrated surface while an opposing lower, interior wall features a pair of spaced apart inner and outer interior longitudinal channels. The interior longitudinal channels serve to secure an elastomeric gasket. A substantial depth of clear space exists inwardly of the serrations and a bottom of the main channel. The depth of free space allows for a broad range of adjustability for tensioning the screen.

The elastomeric gasket features a pair of spaced apart, longitudinally running per and lower ribs featuring a bulb style cross section for engagement with the mating spaced apart inner and outer interior longitudinal channels formed in the lower interior wall of the main channel of the frame members. On an opposite side, the elastomeric gasket has serrations for engaging the mesh or perforations of the screen. The screen is inserted into the channel sections such that the u-shaped hem of the screen faces away from the serrations in the elastomeric gasket.

The screen is locked into place within the channel of the frame members by means of a plurality of locking tabs. In the exemplary embodiment, the locking tabs are of generally rectangular cross-section and are composed of a deformable material. One face of the tabs includes serrations. During assembly, the locking tabs are inserted into the channel of the frame members between the inner face of screen and the upper interior wall of the channel. The screen is locked into place and tensioned by pressing the locking tabs downwardly into the channel such that the serrated face of the tabs engages the serrations on the upper interior wall of the channel while a perpendicular face of the tabs engages an upper edge of the flange of the u-shaped hem on the screen. The degree of screen tension is controlled by the insertion depth of the tabs. During tab insertion the fixed elastomeric gasket beneath the screen mesh is compressed and provides a constant force to hold the tabs in position.

After the screen has been secured within the channel of the frame members as described above, an elastomeric gasket is partially inserted into the opening between the inward face of the screen and the upper interior wall of the channel for the purpose of sealing out the elements.

DETAILED DESCRIPTION OF THE PREFERRED EMBODIMENTS

The present invention will now be described more fully hereinafter with reference to the accompanying drawings, in which preferred embodiments of the invention are shown. The invention may, however, may be embodied in many different forms and should not be construed as being limited to the embodiments set forth herein. Rather these embodiments are provided so that this disclosure will be thorough and complete, and will fully convey the scope of the invention to those skilled in the art. Like numbers refer to like elements throughout.

Figure 1:
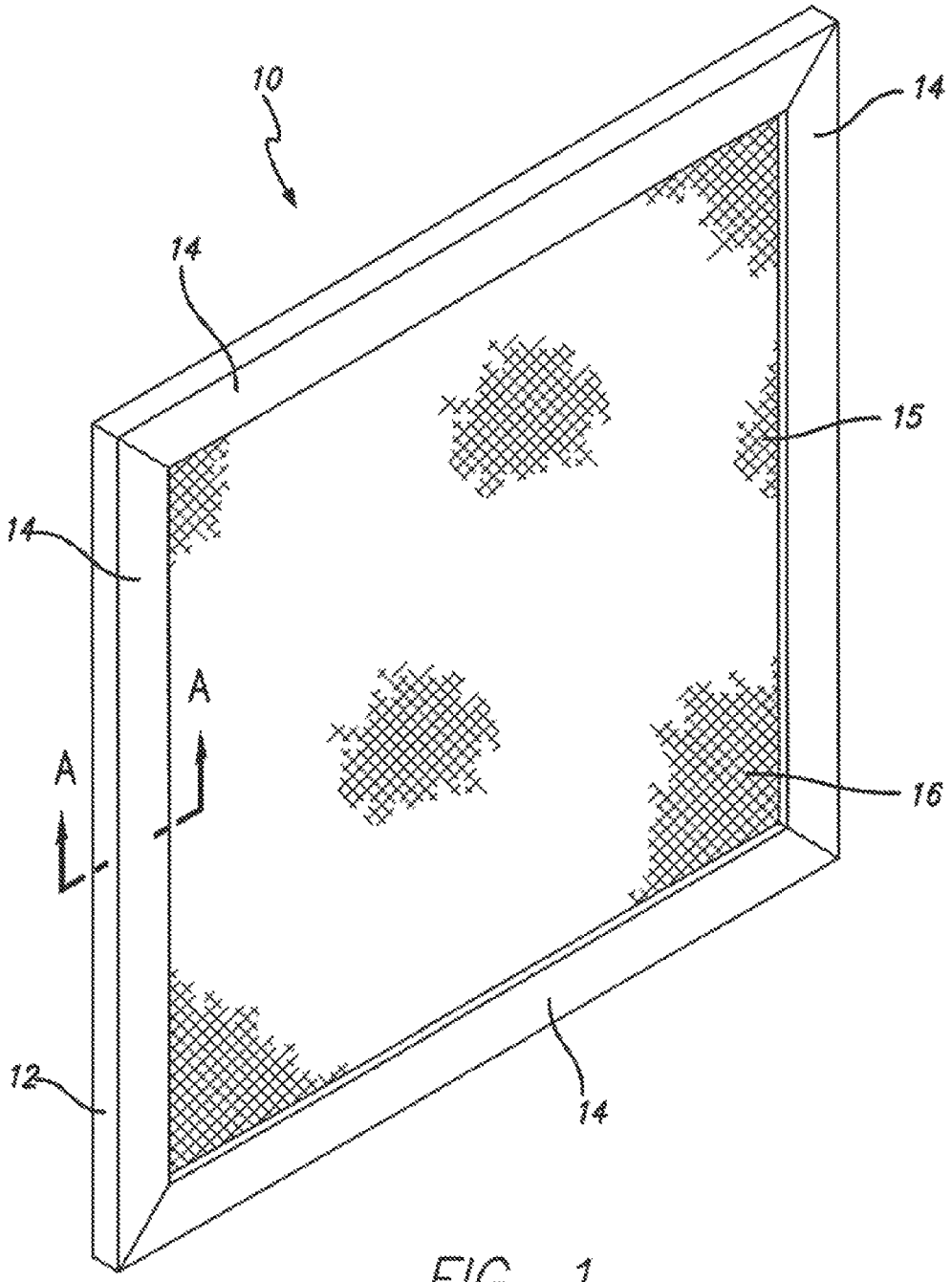
FIG. 1 is a perspective view of a perspective view of a framed screen for closing out an aperture.

With reference to FIG. 1, there is illustrated a screen retention system 10 having a frame 12 comprised of elongate frame members 14 having channel cross sections 18 with a mesh or perforate screen 16, attached to the frame members 14. The screen 16 covers the opening enclosed by the frame 12. In the exemplary embodiment of FIG. 1, the screen retention system 10 is shown as having a discrete frame 12, the outside perimeter of which is sized to fit within an opening in a door, wall or other structure having an aperture. It should be understood however, that the present invention is net limited to a discrete frame or any particular style or shape of frame. In alternative embodiments, the frame 12 may form the primary structural frame for a door, window inset in a wall, or other structure where an aperture is desired.

Figure 2:
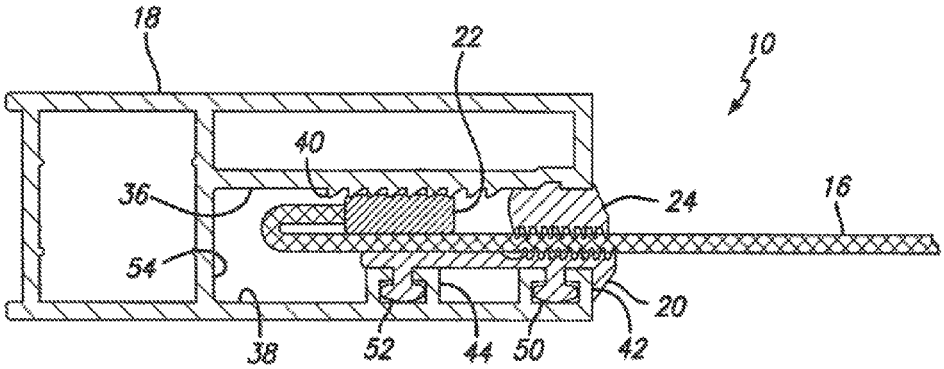
FIG. 2 is a partial side sectional view through the line A-A of FIG. 1, showing the components of an adjustable screen retention assembly in accordance with an illustrative embodiment of the present invention, showing the main channel, screen, retention gasket, locking tab(s) and sealing gasket, among other features.
Figure 3:
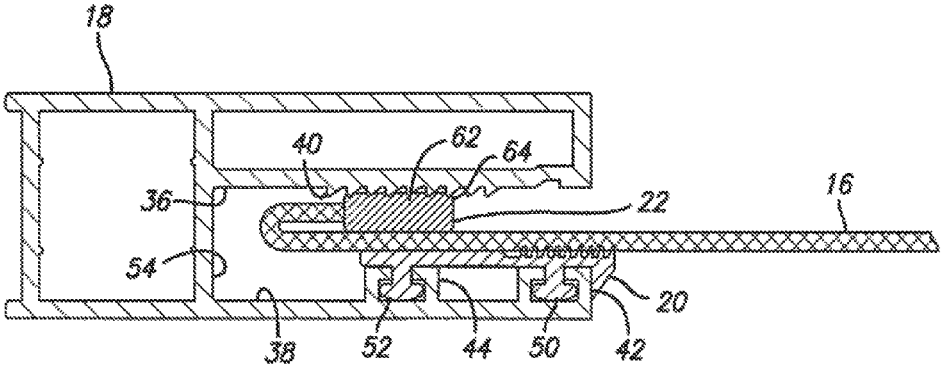
FIG. 3 is a partial side sectional view through the line A-A of FIG. 1, showing the components of an adjustable screen mention assembly in accordance with the illustrative embodiment of FIG. 2, with the sealing gasket removed.
Figure 4:
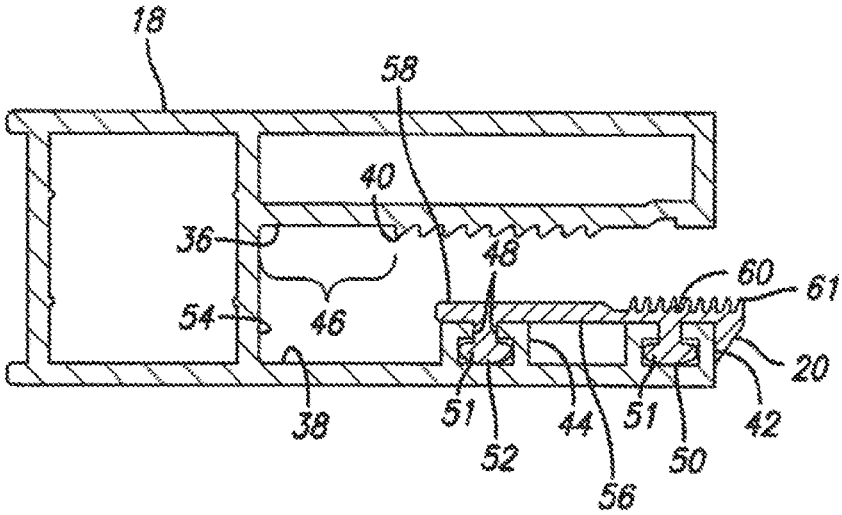
FIG. 4 is a partial side sectional view through the line A-A of FIG. 1, of the components of an adjustable screen retention assembly in accordance with the illustrative embodiment of FIG. 2, with the outer sealing gasket, screen and locking tabs removed.

With reference to FIGS. 2-4, the cross-section 18 of the channel of the frame members 14 of the screen retention system 10 of the present invention is depicted along with the screen 16, screen retention or retaining gasket 20 at least one locking tabs 22 and sealing gasket 24 which comprise the major components of the screen tensioning system 10.

Figure 5:
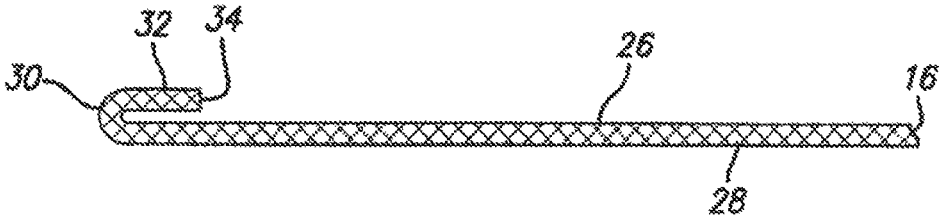
FIG. 5 is a partial side sectional view of the screen used in the illustrative embodiment of the adjustable screen retention assembly of FIG. 2.

Referring now to FIG. 5, the mesh or perforate screen 16 features an inner face 26 and an outer face 28. The perimeter of the semen 16 is formed with a rolled or u-shaped edge horn 30. The edge hem 30 has a flange 32 which folds inwardly over the inner face 26 of the screen 16 and is parallel to, and spaced above, the inner face 26 of the screen 16. The screen 16 may be made from a wide variety of mesh or perforate materials. Wire mesh made from virtually all plastically deformable metallic materials including steel, iron, and aluminum, among others, is suitable. Wire mesh made from type 304 stainless steel is one particularly preferred screen material. Perforate plastic sheet materials that can be formed with the edge hem 30 or its functional equivalent, are also suitable. A stepped surface around the border of a plastic sheet material would be the functional equivalent of the edge hem 30 in a wire mesh material Referring now to FIGS. 2-4, the channel 18 of the frame members 14 features an upper interior wall 36 and a lower interior wall 38. The upper interior wall 36 includes a serrations 40 for engaging the at least one locking tabs 12. The opposing lower interior wall 38 features a pair of spaced apart inner 44 and outer 42 lower interior longitudinal channels. The lower interior longitudinal channels 42 and 44 serve to receive and retain the semen retention gasket 20. The inner 44 and outer 42 lower interior longitudinal channels both feature inwardly facing retaining flanges 48 (see FIG. 4), which serve to capture and retain inner longitudinal ribs 50 and 52 of the screen retaining gasket 20. The inner and outer longitudinal ribs 50 and 52 have a bulb-style cross section 51 which is retained by the inwardly facing retaining flanges 48. A substantial depth of free space 46 (see FIG. 4) exists inwardly of the lowermost of the serrations 40 and a bottom surface 54 of the channel 18. The depth of the free space 46 allows for a broad range of adjustability with respect to tensioning the screen 16. The framing members 14 may be made from a variety of metallic and plastic materials. One exemplary preferred material is extruded aluminum.

Referring to FIG. 4, the screen retention gasket 20 features the spaced apart, longitudinally miming upper 50 and lower 52 ribs with a bulb-style cross section 51 on an inner face 56 of the gasket 20 for engagement with the spaced apart inner 42 and outer 44 lower interior longitudinal channels formed in the lower interior wall 38 of the cross-section 18 of the framing members 14. On an opposite outer face 58 of the gasket 20 are serrations 60 for engaging the mesh of the screen 16. The screen 16 is inserted into the channel section 18 such that the u-shaped hem 30 of the screen faces away from the serrations 60 in the retaining gasket 20. The screen retention gasket 20 may be made from a variety of elastomeric materials as well as deformable plastic materials.

Figure 6:
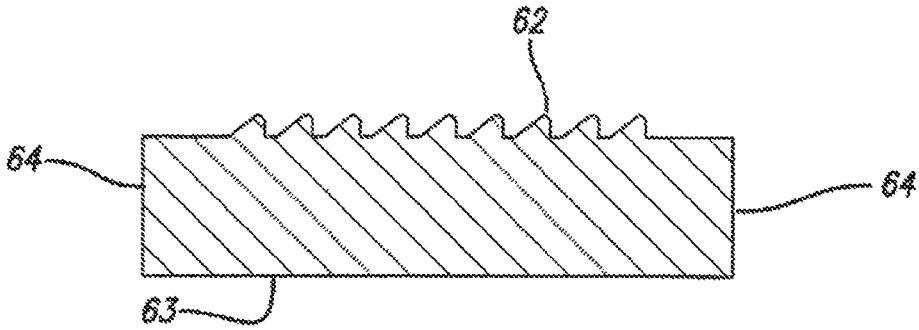
FIG. 6 is a cross sectional view of the locking to shown in the illustrative embodiment of FIG. 2.

The screen 16 is locked into place within the channel section 18 of each frame member 14 by means of the at least one locking tabs 22. Referring now to FIG. 6, in the exemplary embodiment, the at least one locking tabs 22 are of generally rectangular cross-section having a serrated upper face 62 and a planar lower face 63, as well as planar edge faces 64. In the exemplary embodiment, the at least one locking tabs 22 and are composed of a deformable material.

Referring now to FIGS. 2-4, during assembly, the at least one locking tabs 22 are inserted into the channel 18 between the inner face 26 of the screen 16 and the upper interior wall 36 of the channel 18. The screen 16 is locked into place and tensioned by pressing the at least one locking tabs 22 downwardly into the channel 18 such that the serrated upper face 62 of the at least one locking tabs 22 engages the serrations 40 on the upper interior wall 36 of the channel 18 while one of the perpendicular edge faces 64 of the at least one locking tabs engages the upper edge 34 of the flange 32 of the u-shaped hem 30 of the screen 1. The planer lower face 63 of the at least one locking tabs 22 abuts the interior face 26 of the screen 16. The degree of screen tension is controlled by the insertion depth of the at least one locking tabs. The free space 46 of the channel 18, provides clearance for the hem 30 of the screen 16 to be pressed downwardly within the free space 46 and therein allows for screen tension adjustability.

In the exemplary embodiment, the serrations 40 of the upper interior wall 36 of the channel 18 are made from a material comparatively harder than that of the at least one locking tabs 22 to ensure that the serrations 40 of the channel 18 engage and plastically deform the mating serrations 62 the locking tabs 22. The material of the retention gasket 20 is comparatively softer than that of the screen 16, such that the serrations 60 of the gasket 20 engage with the mesh or perforations 15 in the screen 16.

After the screen 16 has been secured within the channels 18 of the frame members 14 as described above, an elastomeric sealing gasket 24 is partially inserted into the opening between the inward face of the screen 16 and the upper interior wall 36 of the channel 14 for the purpose of sealing out the elements.

The above described screen retention system 10 presents several advantages over the prior art. In particular, the free edge 34 of the screen 16 does not require the addition of an electrical insulator because the at least one locking tabs 22 are themselves made (in the exemplary embodiment) from an insulating material, but more importantly the free edge 34 of the screen 16 does not face toward the dissimilar metal (in the exemplary embodiment aluminum) of the upper and lower interior walls 36 and 38 of the channel 18 of the frame members 14, but instead faces toward one of the planer edge faces 64 of the at least one locking tabs 22, thereby preventing dielectric corrosion.

In addition more force can be applied to edge hem 30 of the screen 16 of the present invention without distortion of free edge 34 during tensioning of the screen 16, as compared to, for example, a perpendicular lip as may be found in some prior art designs. This is important because a more highly tensioned screen 16 improves the aesthetics of the finished product, and for security screen applications can withstand greater impact due m it's improved pullout strength. The screen 16 of the present invention 10 may also be more centrally located within the frame 12 preventing an imbalance of the sealing gasket 24 and retention 20 gasket thicknesses, which further contributes to improved appearance. The screen's 16 tension is maintained by compressive force from the retention gasket 20, holding serrated surface 62 of the at least one locking tab 22 into the matching serrations 40 of the upper interior wall 36 of the frame members 14. The screen retention gasket 20 has a high degree of compressibility which allows for the use of screens of different thickness (wire thicknesses in the case of wire mesh screens) without the need to use gaskets of differing thicknesses.

Also, the edge hem 30 of the screen 16 of the present invention has manufacturing advantages over the L-shaped edge hem used in some prior an designs in that formed screens can be stacked after the formation of edge hem 30 without risk of damage to the protective finish of adjacent screens 16, as the free edges 34 of the screen are parallel to the plane of the screen. Screens featuring the U-shaped edge hem 3 of the present invention can be more easily guided into frame members having a narrow opening without risk of damage to the semen doe to the rounded edge profile as compared to the abrupt square or sharp edge of an L-shaped edge hem design. Further manufacturing efficiency is realized due to the fast installation of the tabs as compared to tensioning with a multitude of fasteners.

The foregoing detailed description and appended drawings are intended as a description of the presently preferred embodiment of the invention and are not intended to represent the only forms in which the present invention may be constructed and/or utilized. Those skilled in the art will understand that modifications and alternative embodiments of the present invention which do not depart from the spirit and scope of the foregoing specification and drawings, and of the claims appended below are possible and practical. It is intended that the claims cover all such modifications and alternative embodiments.

The invention claimed is:

1. A screen retention assembly, comprising:

a frame assembly composed of a plurality of frame members configured to frame an aperture, each frame member having a main channel;

a screen, the screen closing out the aperture;

wherein the screen includes an inner face and an outer face and a free edge, the free edge being folded inwardly along a perimeter of the screen to form a hem edge, a folded portion of the free edge extending inwardly from the hem edge, over the inner face of the screen;

wherein the main channel of each of the frame members includes an upper interior wall, a lower interior wall, the upper interior wall including a serrated surface, having a plurality of serrations, the lower interior wall including spaced apart inner and outer longitudinal channels;

a retention gasket, wherein the retention gasket includes an inner face and an outer face, the inner face featuring two spaced apart longitudinal ribs, the outer face including a serrated surface;

at least one locking tab for each frame member, wherein the at least one locking tab for each frame member has a serrated face having a plurality of serrations and an opposite and parallel, planar face, and at least one perpendicular edge face;

wherein the inner and outer longitudinal ribs of the retention gasket are retained within the inner and outer longitudinal channels of the lower interior wall of the main channel of each frame member;

wherein, the screen is disposed between the lower and upper interior walls of the main channel of each frame member and abuts and engages the serrated surface of the outer face of the retention gasket;

wherein, the at least one locking tab for each frame member is disposed between the inner face of the screen and the upper interior wall of the main channel of each frame member, wherein the serrated face of the at least one locking tab engages the serrated surface of the upper interior wall of the main channel and a planar edge of the at least one locking tab for each frame member is perpendicular to the serrated face and abuts the free edge of the screen; and wherein tension on the screen is controlled by adjusting an insertion depth of the at least one locking tab for each frame member within the main channel of each frame member by means of at least one of the plurality of serrations on the serrated face of the at least locking tab engaging at least one of the plurality of serrations on the serrated surface of the upper interior wall of the main channel of each frame member.

2. The screen retention assembly of claim 1, wherein the inner and outer interior longitudinal channels each have a pair of opposed longitudinal retaining flanges and the inner and outer longitudinal ribs of the retention gasket are t-shaped in cross-section for engagement with the retaining flanges of inner and outer interior longitudinal channels.

3. The screen retention assembly of claim 1, wherein the main channel of each of the frame members has a bottom wall separated by a free space defined as the distance from the bottom wall to a lower edge of the serrated surface of the upper interior wall of the channel.

4. The screen retention assembly of claim 1, further including a gasket disposed between the inner face of the screen and the upper interior wall of the main channel of each frame member.

5. The screen retention assembly of claim 1, wherein the main channel of each frame member and the screen are made from electrically conductive materials and the at least one locking tab for each frame member and retention gasket are made from electrically nonconductive materials.

6. The screen retention assembly of claim 1, wherein the at least one locking tab for each frame member is composed of a plastically deformable material which is softer than that of the main channel.

7. A screen retention assembly, comprising:

a frame assembly composed of a plurality of frame members, each frame member having a main channel, configured to frame an aperture;

a screen, the screen closing out the aperture;

wherein the screen includes an inner face and an outer face and a free edge, the free edge being folded inwardly along a perimeter of the screen to form a hem edge, a folded portion of the free edge extending inwardly from the hem edge, over the inner face of the screen;

wherein the main channel of each of the frame members includes an upper interior wall and a lower interior wall, the upper interior wall including a serrated surface having plurality of serrations;

means for securing the screen within the main channel of each of the frame members, wherein the means comprises at least one locking tab for each frame member, the at least one locking tab for each frame member having a serrated face with a plurality of serrations and a perpendicular edge face configured to engage the screen;

wherein tension on the screen is controlled by adjusting an insertion depth of the at least one locking tab for each frame member within the main channel of each frame member by means of at least one of the plurality of serrations on the serrated face of the at least locking tab engaging at least one of the plurality of serrations on the serrated surface of the upper interior wall of the main channel of each frame member.

8. The screen retention assembly of claim 7, wherein the main channel of each of the frame members has a bottom wall separated by a free space defined as the distance from the bottom wall to a bottom edge of the serrated surface of the upper interior wall of the main channel of each frame member.

9. The screen retention assembly of claim 7, further including a gasket disposed between the inner face of the screen and the upper interior wall of the main channel of each frame member.

10. The screen retention assembly of claim 7, wherein the means for securing the screen within the main channel of each frame member further comprises:

a retention gasket, wherein the retention gasket includes an inner face and an outer face, the outer face including a serrated surface;

means for securing the inner face of the retention gasket to the lower interior wall of the main channel of each frame member;

the screen being disposed between the lower and upper interior walls of the main channel of each frame member and abutting and engaging the serrated surface of the outer face of the retention gasket.

11. The screen retention assembly of claim 10, wherein the main channel of each frame member and the screen are made from electrically conductive materials and the at least one locking tab of each frame member and retention gasket are made from electrically nonconductive materials.

12. The screen retention assembly of claim 10, wherein the at least one locking tab for each frame member is composed of a plastically deformable material which is softer than that of the main channel.

13. The screen retention assembly of claim 10, wherein means for securing the inner face of the retention gasket to the lower interior wall of the main channel of each frame member comprises: inner and outer interior longitudinal channels formed on the lower interior wall of the main channel of each frame member which engage longitudinal ribs formed on the inner face of the retention gasket.

14. The screen retention assembly of claim 13, wherein the means for securing the inner and outer interior longitudinal channels formed on the lower interior wall of the main channel of each frame member further includes: a pair of mutually opposed longitudinal retaining flanges on each of the inner and outer lower interior longitudinal channels; and wherein the longitudinal ribs formed on the inner face of the retention gasket are t-shaped in cross-section, wherein the t-shaped cross section of the longitudinal ribs is retained by the retaining flanges of the inner and outer interior longitudinal channels.

* * * * *